United States Patent [19]

Bowen

[11] Patent Number: 4,457,118

[45] Date of Patent: Jul. 3, 1984

[54] INTEGRAL FOUNDATION AND FLOOR FRAME SYSTEM AND METHOD OF BUILDING CONSTRUCTION

[76] Inventor: Alfred J. Bowen, 3214 Fairway Dr., Coeur d'Alene, Id. 83814

[21] Appl. No.: 292,893

[22] Filed: Aug. 14, 1981

[51] Int. Cl.[3] ..... F02D 27/00

[52] U.S. Cl. ..... 52/292; 52/293; 52/742; 52/693

[58] Field of Search ..... 52/293, 299, 690, 693, 52/294, 292, 515, 517, DIG. 11, 742

[56] References Cited

U.S. PATENT DOCUMENTS

| | | | |
|---|---|---|---|
| 3,651,612 | 3/1972 | Schmitt | 52/693 |
| 4,001,999 | 1/1977 | Chandler | 52/693 |
| 4,005,556 | 2/1977 | Tuomi | 52/299 X |
| 4,015,375 | 4/1977 | Lindsay | 52/292 X |
| 4,033,081 | 7/1977 | Perkins, Jr. | 52/263 |
| 4,261,149 | 4/1981 | Gustafson | 52/292 |
| 4,263,762 | 4/1981 | Reed | 52/293 |
| 4,313,688 | 2/1982 | Daniels | 52/299 |

OTHER PUBLICATIONS

*The Condensed Chemical Dictionary,* 8th edition, p. 234.

*Primary Examiner*—Carl D. Friedman

*Attorney, Agent, or Firm*—Wells, St. John & Roberts

[57] ABSTRACT

A combined wooden floor joist and foundation wall stud truss and construction process is disclosed whereby a wooden foundation wall and floor trusses for a framed building are erected simultaneously. The individual truss members include elongated floor joist members that mount all weather treated foundation wall studs by means of truss clips. The studs have side surfaces that are coplanar with side surfaces of the floor joists. A number of the trusses may be secured to a footing along a treated sill plate, and tied together by the sill plate and by treated plywood sheathings nailed to the studs. A rim joist can also be used to tie the individual trusses together into a completed frame unit including foundation wall studs ready for sheathing and floor joists ready for subflooring. The process basically involves preparation of the footing, placement of the sill plates, and installation of the truss units. The floor joists and foundation wall studs are constructed simultaneously and inherently with installation of the truss units.

31 Claims, 13 Drawing Figures

FIG 10
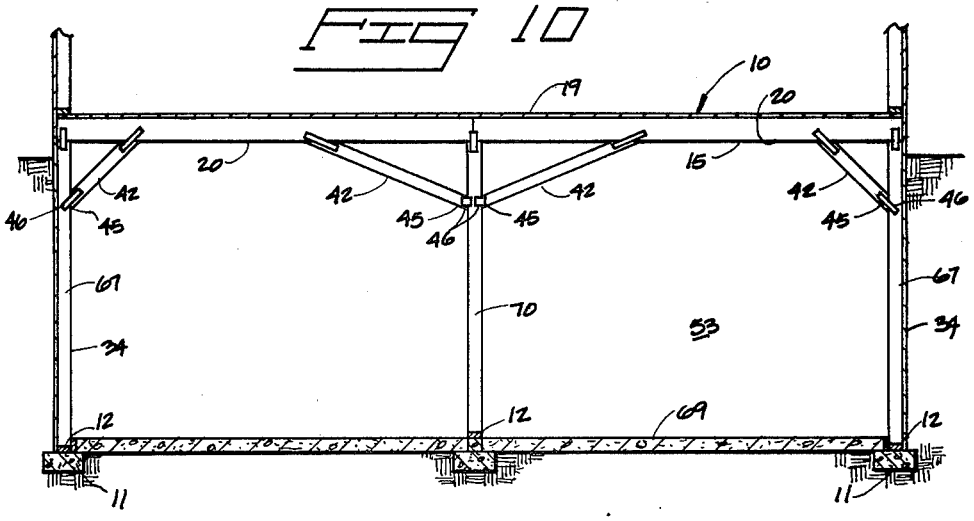
FIG 12
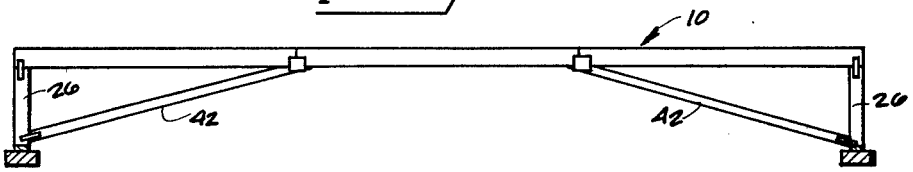
FIG 13
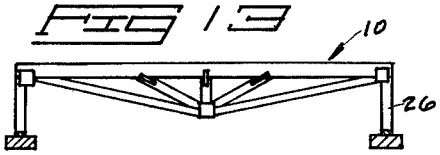
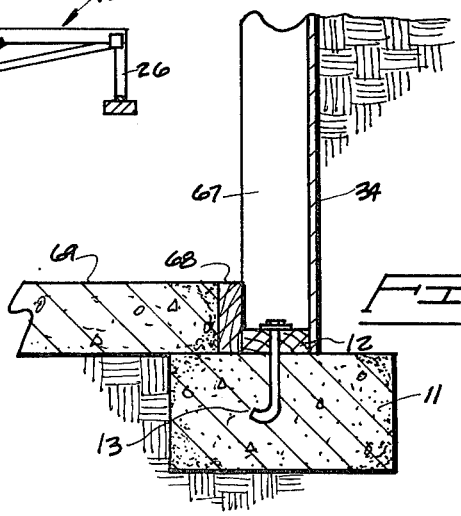
FIG 11

INTEGRAL FOUNDATION AND FLOOR FRAME SYSTEM AND METHOD OF BUILDING CONSTRUCTION

BACKGROUND OF THE INVENTION

The present invention relates to frame building truss arrangements and construction processes utilizing wooden foundation walls.

Typical frame building construction involves a well worn procedure of excavating, pouring a concrete footing, "forming-up" for pouring a foundation wall, pouring the wall, waiting for the concrete in the wall to cure, removing the forms, setting a sill plate, and installing the floor joist on the sills. This is all done before the wall and roof framing can be done. The tedious procedure of laying a foundation wall is expensive due to the ever increasing costs of concrete, and labor costs in constructing and dismantling the forms. Material is often wasted in the form materials, which must eventually be discarded. Precious time is lost not only in the forming up process but in the curing time required before construction can continue. Thus, it can be understood that a significant part of the expense in framing construction goes for the foundation wall.

This expense has remained even though the Federal Housing Administration has approved treated wood as foundation wall material. Although the treated wood materials, including treated foundation wall studs and plywood sheathing, may be less costly than concrete, labor has more than made up the savings. Time involved in cutting the studs, nailing a plate across the tops, securing floor joist for support, and attaching the treated plywood sheathing often raises the overall costs above similar costs for concrete foundation. Contractors have therefore been reluctant to construct with wooden foundations.

It is clearly evident that there is a severe need for affordable housing, especially in the present times when the inflation rate seems to be outrun only by elevating mortgage loan interest rates. Builders have therefore been eagerly seeking new and less expensive building systems so a broader range of purchasers can be accommodated. Studies have been completed wherein every expense down to the number of nails used is justified in order to reduce building costs. Some savings have been produced but not significant enough to broaden the range of potential buyers.

Some success has been achieved by "pre-fab" builders who save costs by mass producing homes at a single location, then shipping the finished product to a building site. This approach has only limited success, depending upon the distance to the home site, dangers of transportation, and design limitation due to transport size requirements. Still, though, the standard concrete foundation wall structure is typically used. Also, the concrete must be allowed to cure before the prefab home is lowered into place. Alternately, the foundation wall is formed of treated wood, using the same system briefly described above. "Prefab" is therefore not a universal answer to the affordable housing dilemma.

Other forms of housing do not require any form of permanent foundation. "Mobile homes" are typically supported entirely above the ground with framing that is substantially self supporting. Heavy foundation walls are therefore unnecessary. Nevertheless, certain undercarriage structurs have been developed that can be installed between a mobile home and the ground surface in order to provide stable, more permanent support. One such arrangement is illustrated in U.S. Pat. No. 4,261,149 which discloses a mobile home support comprised of horizontal metal I-beam and upright adjustable support posts. Diagonal braces are provided for stability intermediate the posts and to brace the supports. The intent of this support system is to provide level support to a structure already provided with self supporting framing. The system appears to be serviceable for its intended use with mobile homes. It is pointed out however, that the metal structure cannot be used as typical underground foundation framing due to the peculiar construction adapted especially for mobile homes. Building code requirements will not allow the use of metal as an underground foundation.

"Modular" building systems have been proposed as a more affordable form of construction. Many such units are presently on the market, ranging from "kits" wherein precut lumber is supplied along with necessary building components, to prebuilt modules such as complete wall units that can be quickly fitted together on a previously prepared foundation. Provisions for a concrete foundation are supplied along with the modular building system disclosed in U.S. Pat. No. 4,033,081 to Perkins. Concrete filled metal pedestals are used for support; a complete departure from well known framing techniques.

The present invention involves a framing construction system that allows standard frame structures of housing to be produced efficiently, using universally available materials and that does not require special training or expertise of the framing carpenter. The present invention involves the use of a truss that is comprised of a combination of a floor joist and foundation wall stud. When the trusses are attached to a footing sill plate, the floor trusses and foundation stud wall are erected simultaneously. This substantially reduces the time involved in framing the foundation wall and floor joist and lowers cost of materials used.

It is therefore a primary object of the present invention to provide a building system that can be used effectively and efficiently to substantially reduce the overall cost of framed construction.

Another object is to provide such a system that is versatile, allowing for wide discretion and style of construction.

Another object is to provide such a system that will produce a significant affect on construction completion dates in addition to savings in materials and labor cost, thereby favorably affecting cash flow situations and reducing borrowing requirements.

A still further object is to provide such a system that incorporates relatively standard carpentry practices well familiar to experienced framing contractors and therefore can be easily learned and used.

A still further object is to provide such a system that makes use of widely available materials that can be easily provided by standard truss manufacturers without requiring substantial retooling.

These and still further objects and advantages will become apparent upon reading the following description and in view of the attached drawings.

BRIEF DESCRIPTION OF THE DRAWINGS

Forms of the present invention are illustrated in the attached drawins in which:

FIG. 9 shows an extended arrangement of the present system;

FIG. 10 shows use of the present system with extended foundation wall studs to be used as basement walls; and FIG. 11 is a detail of the footing and floor arrangement shown in FIG. 10;

FIG. 12 shows another extended truss arrangement of the present system; and

FIG. 13 shows the present system with an unsupported center member.

DETAILED DESCRIPTION

Figure 1:
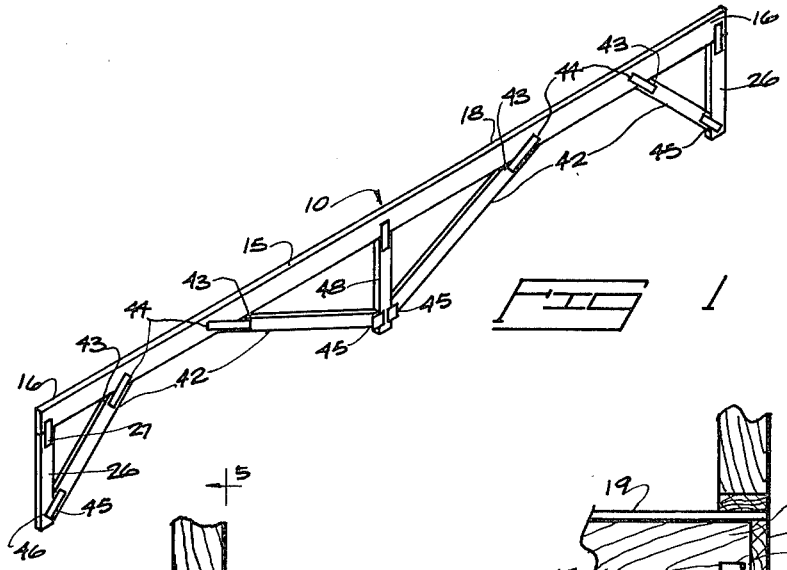
FIG. 1 is a pictorial view of an integral floor and foundation wall frame component of the present system.
Figure 2:
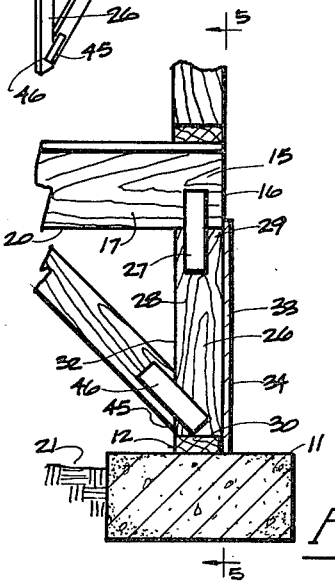
FIG. 2 is a detail elevation of the present system installed.

The present invention is embodied in system and method of construction in which a unique floor and foundation wall frame component 10 is used to simultaneously form a building foundation wall and a floor joist system on a preformed footing 11 and attached sill plate 12.

The basic parts of the component 10 include an elongated floor joist member 15. Each floor joist member 15 includes a length dimension between opposed ends 16. The length dimension will typically be selected from standard lumber lengths according to spans allowed by building codes. It is preferred that the floor joist member be a standard size wooden plank. In fact it is conceivable that lumber sizes used with the present system can vary from 1×4s to heavy laminated beam members.

Figure 5:
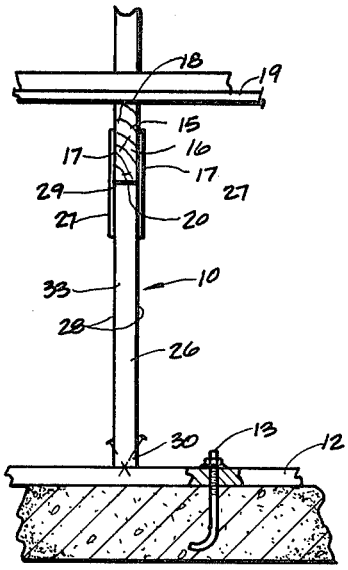
FIG. 5 is a fragmentary end detail as seen from the line 5—5 in FIG. 2.
Figure 6:
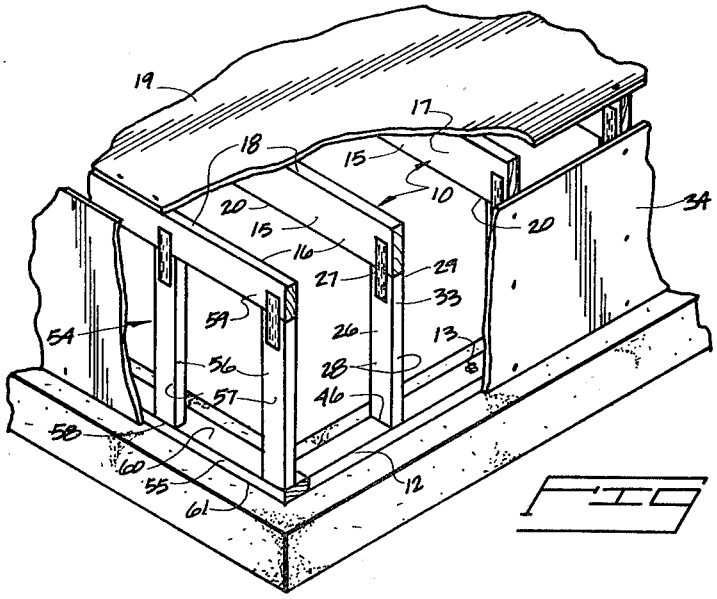
FIG. 6 is a fragmentary pictorial view showing the present system with foundation wall sheathing and subflooring in place.

The floor joist member 15 will include parallel opposed side surfaces 17 defining a transverse width dimension. The side surfaces 17 are interconnected by a horizontal top edge 18 that is used to support a subfloor 19 as shown in FIGS. 5 and 6. The top edge 18 is spaced by a depth dimension from a parallel bottom edge surface 20. When the component 10 is erected, the bottom edge 20 faces the ground surface 21. The distance between edge surfaces 18, 20 is herein termed the depth dimension.

The second basic element of the present component 10 is at least one all weather treated wooden foundation wall stud 26. The foundation wall stud 26 is mounted adjacent to one of the joist ends 16 by means of truss clips 27. The wall stud 26 has side surfaces 28 that are preferably coplanar with the side surfaces 17 of the floor joist member. The stud extends from a top end 29 abutting the bottom edge of the floor joist to a bottom end 30. The bottom end 30 is adapted to be affixed to the sill plate 12 as shown in FIG. 5.

The truss clips 27 are preferably used with all conceivable forms of the present invention. It is the clips 27 that are used to rigidly hold the joist members and stud 26 together with the top stud end 29 abutting the bottom joist edge 20. The clips also assure that the side surfaces 17, 28 of the joist and stud respectively are coplanar. The size of the clips 27 required may be calculated for stress requirements in different situations. Nevertheless, it is preferred that the plates be between 16 and 20 gauge galvanized or stainless steel plate. It has been found in actual practice that 20 gauge galvanized steel plate serves well and is considerably more economical than stainless steel of similar capabilities.

The stud 26 includes an inner edge surface 32 that is perpendicular to the joist edge surfaces 18 and 20. It also includes an outer edge surface 33 that is parallel to the edge surfce 32 and adapted to receive all weather treated wood sheathing 34.

The studs, sill plates, and sheathing 34 must all be chemically treated. It is preferred that copper arsenate solutions, such as ammoniacal copper aresenate or chromated copper arsenate solutions be impregnated into the wood surfaces to protect against moisture, decay and insects. It is preferred that the amount of impregnation be sufficient to produce a 0.60 lb. retention of chemical per cubic foot of wood. It is also preferred that the chemical penetrates at least 40% of the wood thickness from each surface, and that the wood have a maximum moisture content of 18%.

It should therefore be understood that the basic truss arrangement of the present invention is comprised of one floor joist member 15 and at least one stud 26 affixed thereto by means of one or more truss clips 27 adjacent one of the joist ends 16.

Figure 7:
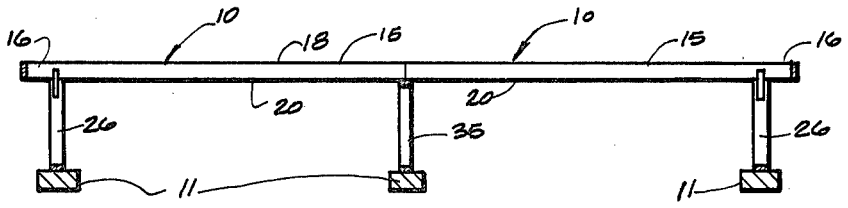
FIG. 7 illustrates a basic form of the present system.

FIG. 7 exemplifies the versatility of the present basic truss arrangement. It may be noted in FIG. 7 that the foundation wall studs 26 of the two opposed trusses 10 shown are located slightly inward of the adjacent joist ends 16. This leaves a slight overhang of the floor joist 15; a situation which may prove to be desirable in some building styles and which increases the overall allowable span for the joist. As illustrated in FIG. 7, the remote joist ends are supported on a central upright post 35. Post 35 is supported on an intermediate footing section.

Figure 3:
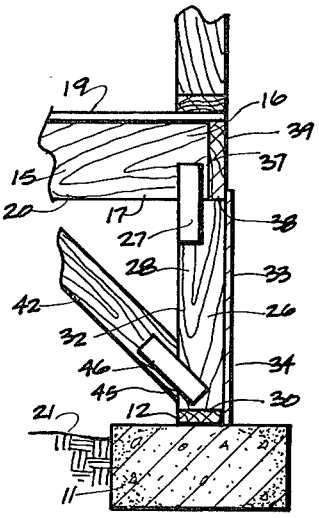
FIG 3 is a view similar to FIG. 2 only showing use of a rim joist with a modified form of the frame system.

An alternate arrangement is illustrated in FIG. 3 wherein a notch 37 is formed by one of the joist ends 16 and an outwardly extending portion 38 of a stud top end 29. The notch formed is dimensioned specifically to receive a rim joist 39. The rim joist 39 can be used to add stability to a succession of truss members mounted to a sill plate 12. The size of notch 37 is such that an exterior facing surface of the rim joist 39 will be coplanar with the outer edge surfce 33 of the successive truss studs.

It may be desirable to include frame webbing 42 as shown in FIGS. 1 through 4, 9, 10, 12, and 13, depending upon span requirements and whether there is to be a basement included, as shown in FIG. 10. The webbing 42 is comprised of dimensional lumber having thickness dimensions preferably equal to that of the floor joist 15. Each of the webbing members 42 will include a top end 43 affixed by clips 44 to the joist member 15. Each will also include a bottom end 45 attached to a foundation wall stud 26 by clips 46. It is preferred that the bottom web ends 45 be situated elevationally from the stud bottom ends 30 at least one foot from the ground surface when the truss is installed. In this manner, the webbing used can be untreated wood.

The size of the joist members 15 and the span to be covered are two factors to be considered when deciding whether to use webbing. It is possible, for example, that a 2×10 joist member can span a distance of 16 feet. Therefore, a 16 foot long truss with a 2×10 joist member would require no webbing. Longer spans, however, would require webbing.

FIGS. 12 and 13 are examples of acceptable forms of webbing. FIG. 12 shows three individual joist members joined end-to-end and supported at the joined ends to complete the integral frame configuration. If the joined joist members are of, say 2×10 nominal lumber, then the allowable span for each member may be 16 feet. The total span may thus be 48 feet. The webbing in this case is provided to support the joined abutting ends of the joist members.

FIG. 13 shows a method of bracing the joist member 15 without requiring intermediate support. Here the webbing serves to lend rigidity to the joist member and thereby lengthen the overall allowable span, without requiring a central support footing.

Intermediate supports 48 as shown in FIG. 9 may also be used when long distances are to be spanned by the floor joist members 15. The intermediate supports 48 will be supported by intermediate footings and sill plates 12. It may also be noted in FIG. 9 that the intemediate supports 48 are situated at joined ends of several lengths of boards that are connected end-to-end to produce a single floor joist member 15, as with the joist shown in FIG. 12. Using this method of frame construction, any resonable distance can be spanned by the component 10.

Figure 8:
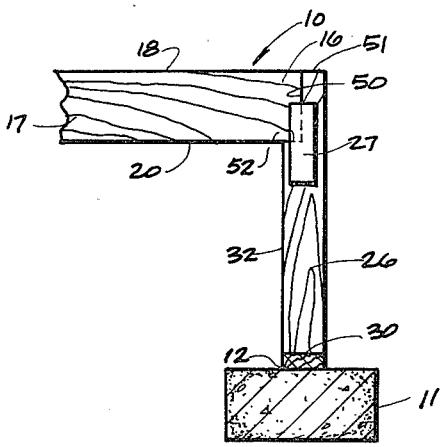
FIG. 8 shows an alternate joint structure that may be used with the present system.
Figure 7:
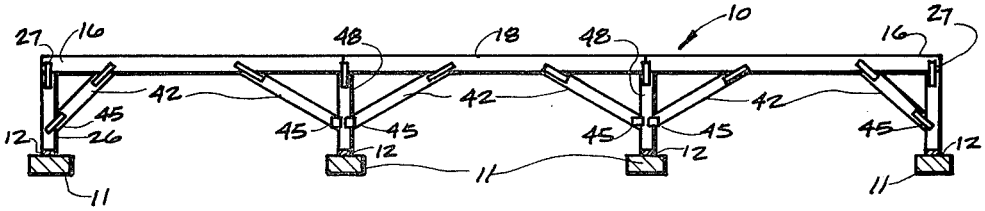

FIG. 8 shows an arrangement for interconnecting the stud 26 with the floor joist member 15. Here, a notch 50 is formed in the inside of the stud 26. The notch is equal in dimension to the depth dimension of the floor joist member (between edge surfaces 18, 20). Therefore, the top stud surface 29 is split into a top portion 51 that is coplanar with the top edge 18 of the floor joist, and a portion 52 that is coplanar with the joist bottom edge 20. The truss clip 27 is situated to secure both members in relation to the joint.

Figure 4:
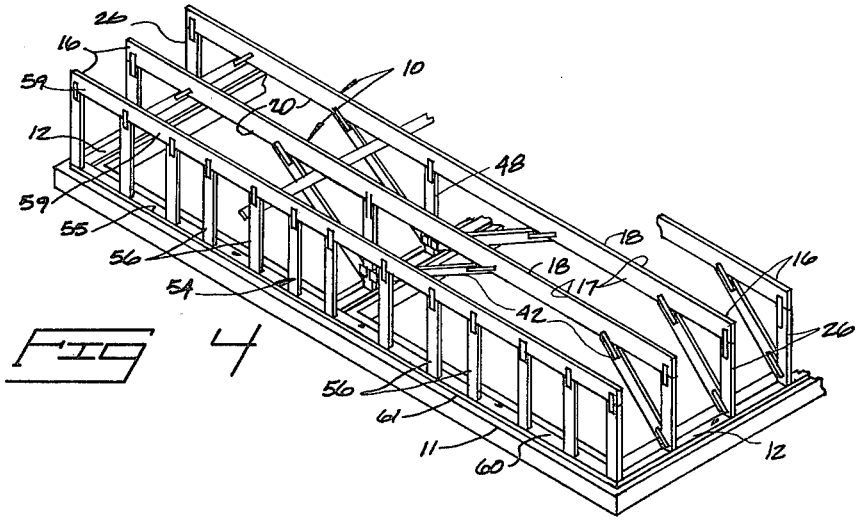
FIG. 4 is a pictorial view of foundation wall and floor joist framing using the present system.

FIGS. 4 and 6 illustrate another form of frame component that is particularly adapted for mounting at opposed ends of a building foundation. It is thus termed a foundation end wall frame component 54. The end wall frame component 54 is preferably produced with an integral sill plate 55. It also includes a plurality of upright studs 56 that extend between the plate 55 and an end wall joist 59 to allow ample surface area for nailing of the treated sheathing 34.

Ths studs 56 include surfaces identical to those described for the foundation wall studs 26. However, the wide side surfaces 57 of the studs 56 face outwardly to abut the sheathing 34. These surfaces 57 are also coplanar with outer edge surfaces 58 of the end sill plate 55 and end joist member 59. A smooth, planar surface is therefore presented for receiving the all weather treated sheathing 34.

The sill plates 55 are identical to the plates 12 that are affixed to longitudinal sections of the footing. They each include a top surface 60 that abuts the bottom ends of the end wall studs 56. A bottom plate surface 61 rests against the footing. An inner edge surface 62 is opposite the outer edge surface 58.

FIGS. 10 and 11 illustrate the present frame component arrangement for use with construction with provisions for a basement 53. Here, elongated foundation wall studs 67 are provided with the remainder of the truss arrangement substantially identical to the frame arrangements shown in FIGS. 1, 7 and 9. Here, however, the studs 67 are also used for the interior perimeter wall for a basement. Elongated intermediate members 70 may also be used to support the midsection of the joists 15.

FIG. 11 shows a detail of the construction used with the elongated studs 67 to provide for a concrete basement floor 69. The basement floor 69 is poured within the confines of a peripheral edging 68. The edging 68 may be affixed to the sill plate 12 or studs 67. A top edge surface 70 of the edging 68 can be used as a reference edge for leveling the concrete floor. Furthermore, the floor and edging serve as a brace against the sill plate 12 and studs 67, against inward pressure produced by the earth adjacent for foundation.

The construction process utilizing any form of the present integral frame component 10 begins with the forming of a footing 11 about the perimeter of the structure to be built. The footing 11 is constructed according to standard practices and may be either a solid footing formed of concrete or, alternatively, can be compacted gravel (depending upon code requirements). The typical structure is rectangular, having a width and length dimension. In such circumstances, the component 10 will extend across the width of the structure, requiring the minimum frame length. Sill plates 12 of all weather treated wood are anchored to longitudinal sections of the footing 11, the transverse section usually being left bare to receive the end frame components 54. Upright anchor bolts 13 are provided for this purpose. The sill plates are drilled and fitted over the studs. Projecting ends of the studs receive nuts and washers. The nuts are tightened to firmly secure the sill plates to the footing.

The sill plates 12 extending along the length of the structure are marked at successive increments where the frame components 10 are to be positioned. Individual frame components 10 are then moved into position, set upright with the studs vertical, and attached to the sill plates by toenailing as shown in FIG. 5. It is typical that the frame components are equally spaced along the length of structure and that the outer stud surfaces 33 are aligned in a coplanar relationship with outwardly facing surfaces of the sill plates 12.

When at least several of the frame components members are in position, the treated sheathing 34 and subflooring 19 can be attached. Foundation wall sheathing is accomplished simply by nailing the sheathing material in place over the exposed outer stud surfaces 33 and sill plates 12. This completes the foundation wall. The subflooring 19 can be installed simultaneously simply by measuring, cutting and securing the flooring materials in place along the aligned top edge surfaces 18 of the floor joists 15.

It is important to note that the process may involve simultaneous formation of the foundation wall along with formation of the flooring. This is so because the foundation wall studs are erected simultaneously with the floor joist.

Use of the present system and method for construction has been in actual use and has had a substantial effect on overall building costs. In fact, actual practice has indicated an overall cost reduction of 17%.

Furthermore, the actual construction process is greatly expedited through use of the present frame component and the associated construction process. Where standard construction processes could produce a complete foundation with floor trusses in place in several days, the present process can be completed in under two days. This greatly decreases the overall construction time for the complete structure and results in a significant savings of labor and, in many situations, decreases borrowing requirements due to the short time span available from the beginning of construction until the purchaser is allowed possession.

I claim:

1. An integral floor and foundation wall frame component for use in a framed building structure having (a) a peripheral all weather treated wooden foundation resting on a below grade footing sill plate for supporting the framed building structure, (b) said peripheral treated wooden foundation including an external covering of all weather treated wooden sheathing abutting subgrade backfill material externally banked against the foundation, and (c) flooring supported by the all weather treated wooden foundation, said frame component comprising:

an elongated floor joist member of rectangular cross section having (a) a longitudinal length dimension between opposed ends, (b) a transverse width dimension between longitudinal side surfaces, and (c) a depth dimension between opposed top and bottom edge surfaces joining the side surfaces with the top edge surface adapted to receive the floor;

a wooden all weather treated foundation bearing wall stud having (a) a top end with a first surface engaging the bottom surface of the floor joist member for supporting the joist member, (b) a free bottom end extending below the floor joist member with a second bearing surface for engaging and bearing against the below grade footing sill, (c) side surfaces coplanar with the side surfaces of the floor joist member and (d) parallel outside and inside edge surfaces joining the side surfaces and perpendicular to the edge surfaces of the floor joist member, the inside edge surface being adapted to receive the treated wooden foundation wall sheathing thereon and support subgrade backfill; and truss clip means rigidly joining the floor joist member and the foundation wall stud to form the integral floor and foundation wall frame component.

2. The floor and foundation wall frame component as claimed by claim 1 further comprising:

a web member joined by truss clips to the floor joist and the foundation wall stud adjacent its bottom end surface.

3. The floor and foundation wall frame component as claimed by claim 1 further comprising:

an intermediate support member spaced along the floor joist member from the foundation wall stud, affixed to the floor joist member in parallel relation to the foundation stud member and adapted to be supported on a treated intermediate wooden footing sill.

4. The floor and foundation wall frame component as claimed by claim 3 further comprising:

a diagonal web member joined at a top end by truss clips to the floor joist and at a bottom end to the intermediate support member.

5. The floor and foundation wall frame component as claimed by claim 4 wherein said bottom end of the diagonal web is joined to the intermediate support member at least one foot above the intermediate footing sill.

6. The floor and foundation wall frame component as claimed by claim 1 wherein the floor joist member is formed of untreated wood and wherein the length dimension of the foundation wall stud between top and bottom ends thereof is sufficient to support the floor joist member above the sill plate at a distance of at least one foot from the footing sill.

7. The floor and foundation wall frame component as claimed by claim 1 wherein the truss clip means is comprised of:

metal plates on opposite side surfaces of the joist member and foundation wall stud;

wherein the metal plates are between 16 and 20 gauge material.

8. The floor and foundation wall frame component as claimed by claim 7 wherein the plates are formed of a rustproof material such as galvanized or stainless steel.

9. The floor and foundation wall frame component as claimed by claim 1 wherein the truss clips are comprised of metal plates on opposite side surfaces of the joist member and foundation wall stud.

10. The floor and foundation wall frame component as claimed by claim 1 wherein the foundation wall studs are of sufficient length to support the floor joist member at least one foot from the footing sill plate when the bottom stud ends are secured to the footing sill plate.

11. The floor and foundation wall frame component as claimed by claim 10 wherein the truss clip means is comprised of:

16 to 20 gauge metal plates on opposite side surfaces of the joist member and the foundation wall stud.

12. The floor and foundation wall frame component as claimed by claim 11 wherein the plates are formed of a rustproof material.

13. The floor and foundation wall truss as claimed by claim 1 wherein the foundation wall stud is impregnated with an all weather wood treatment of a copper arsenate solution.

14. An integral floor and foundation wall frame component for attachment to a below grade footing sill plate and for receiving a wooden all-weather treated below grade foundation wall and a floor, comprising:

an elongated floor joist member of rectangular cross section having (a) a longitudinal length dimension between opposed ends, (b) a transverse width dimension between longitudinal side surfaces, and (c) a depth dimension between parallel opposed top and bottom edge surfaces with the top edge surface adapted to receive the floor;

wooden all-weather, treated foundation bearing wall studs having (a) a length dimension between a top stud end and a free bottom stud end with the free bottom end adapted to be secured to the footing sill plate, (b) parallel inside and outer edge surfaces, and (c) opposed side surfaces joining the inside and outer edge surfaces, the outer edge surface for receiving the treated foundation wall to support subgrade backfill;

wherein the foundation bearing wall studs are mounted to the floor joist member adjacent each end thereof, with the top stud ends engaging and supporting the bottom edge surface of the floor joist member and with the stud side surfaces coplanar with the side surfaces of the floor joist and the inside stud edge surfaces parallel and facing one another and with the outside edges facing outwardly in opposite directions and with the free bottom stud ends adapted to engage the below grade footing sill plates; and truss clip means rigidly affixing the foundation wall studs to the floor joist member to form the integral floor and foundation wall truss with the free bottom stud ends.

15. The floor and foundation wall frame component as claimed by claim 14 wherein the foundation wall studs are of sufficient length to support the floor joist member at least one foot above the below grade footing sill plate when the bottom stud ends are secured to the footing sill plate.

16. The floor and foundation wall frame component as claimed by claim 14 wherein the outer edge surfaces of the foundation wall studs and portions of the top stud ends project outwardly of the floor joist member ends, so the floor joist member ends and the portions of the top wall stud ends form an open rectangular recess adapted to receive and mount a rim joist.

17. The floor and foundation wall frame component as claimed by claim 14 wherein the truss clips are comprised of 20 gauge metal plates of galvanized steel, on opposite side surfaces of the joist member and foundation wall studs.

18. The floor and foundation wall frame component as claimed by claim 14 wherein the foundation wall studs are impregnated with an all weather treatment of a copper arsenate solution.

19. A wooden foundation and floor joist building system for construction on a rectangular below grade supporting footing, comprising:

a pair of spaced elongated foundation end wall and floor joist members, each including a treated wooden end wall sill plate, a number of treated wooden upright foundation bearing end wall studs attached at bottom ends to the sill plate, and elongated end floor joist affixed to top ends of the foundation end wall studs with the end wall studs and end floor joists of each pair having coplanar side walls;

wherein the foundation end walls are adapted to be secured at opposed ends of the footing;

intermediate foundation wall and floor joist frame components parallel to and spaced equally between the foundation end wall and floor joist members, with each including upright treated wood foundation bearing wall studs having upper ends directly affixed to and supporting elongated floor joist and free bottom ends extending below the floor joists, and with the joist and bearing stud members having coplanar side surfaces; and treated wood sill plates for resting against the below grade footing and affixed to the free bottom ends of the foundation wall studs of the intermediate frame components, supporting the floor joists of the intermediate trusses at elevations above the footing equal to the elevations of the end floor joist of the foundation end wall and floor joist members.

20. The system as claimed by claim 19 wherein:

the end wall sill plate of each foundation end wall includes parallel inner and outer side edges joining top and bottom side surfaces;

the bottom side surface is adapted to rest against the foundation footing and the top surface abuts bottom ends of the end wall studs;

the end wall floor joist and end wall studs include coplanar inner and outer side surfaces; and the outer surfaces of the end wall studs are coplanar with the outer side edge of the end wall sill plate.

21. The system as claimed by claim 19 further comprising a rim joist extending between the end floor joists and affixed to the ends of the intermediate floor joists, to rigidly interconnect the end members and the intermediate foundation wall and floor joist frame components.

22. The system as claimed by claim 19 wherein the end wall studs are attached to the end floor joist and the foundation end wall studs are attached to the intermediate floor joists by 16 to 20 gauge metal truss clips.

23. The system as claimed by claim 22 wherein the metal truss clips are formed of a moisture proof metal such as galvanized or stainless steel.

24. The system as claimed by claim 22 wherein the metal truss clips are formed of 20 gauge galvanized steel plates.

25. The system as claimed by claim 19 wherein the sill plates, and wall studs, and intermediate foundation wall studs are impregnated with an all weather wood treatment of a copper arsenate solution.

26. A building process for constructing an integral floor and foundation utilizing a plurality of integral floor joist and wooden all weather treated foundation wall stud frame components, comprising the steps of:

(a) forming a footing about a desired perimeter at a desired subgrade elevation;

(b) placing an all weather treated wooden sill plate having planar top and bottom side surfaces and opposed outer and inner side edges on the subgrade footing with the bottom side surface down and the outer side edges facing outwardly;

(c) positioning a series of the integral floor joist and foundation wall stud frame components at spaced parallel locations on the sill plate, with the floor joists projecting horizontally across the perimeter elevationally above the footing with said studs extending upright at spaced locations along the sill plate and with free bottom ends of the studs being secured to the sill plate; and (d) securing all weather treated sheathing panels to the sill plate and foundation wall studs to form the foundation walls.

27. The process as claimed by claim 26 wherein the step of securing the combined floor joist and foundation wall stud frame components is accomplished by nailing the free bottom ends of the studs to the sill plate with the coplanar side edges of the studs and floor joists upright.

28. The process as claimed by claim 26 comprising the further step of securing a floor to the floor joists.

29. The process as claimed by claim 26 comprising the further step of:

securing the floor joists and wall stud frame components relative to one another at the spaced parallel locations by attaching a rim joist to the series of frame components along the foundation wall studs.

30. The process as claimed by claim 26 including the further step of:

securing an elongated foundation end wall and floor joist member across an end of the footing perimeter, said end wall and floor joist member including a treated wooden end wall sill plate, a number of treated wooden upright foundation end wall studs attached at bottom ends to the sill plate and elongated end floor joist affixed to top ends of the foundation and wall studs with the end wall studs and end floor joist having coplanar side walls.

31. The process as claimed by claim 30 wherein the step of securing all weather treated sheathing panels is accomplished with regard to the end wall and floor joist member by nailing the panels to the end wall sill plate, the end wall studs, and the end wall floor joist.

* * * * *